US005176118A

United States Patent [19]

Norota

[11] Patent Number: 5,176,118

[45] Date of Patent: Jan. 5, 1993

[54] APPARATUS FOR CONTROLLING INTERNAL COMBUSTION ENGINE

[75] Inventor: Kazuhiko Norota, Toyota, Japan

[73] Assignee: Toyota Jidosha Kabushiki Kaisha, Toyota, Japan

[21] Appl. No.: 811,330

[22] Filed: Dec. 20, 1991

[30] Foreign Application Priority Data

Dec. 25, 1990 [JP] Japan ..... 2-405623

[51] Int. Cl.[5] ..... F02D 41/14

[52] U.S. Cl. ..... 123/435; 123/436; 123/192.1

[58] Field of Search ..... 123/435, 436, 419, 425, 123/192.1

[56] References Cited

U.S. PATENT DOCUMENTS 4,509,484 4/1985 Gertiser ..... 123/436
4,683,856 8/1987 Matsuura et al. ..... 123/436
4,776,312 10/1988 Yoshioka et al. ..... 123/436
4,924,832 5/1990 Abe ..... 123/436

FOREIGN PATENT DOCUMENTS 2-67446 3/1990 Japan .

*Primary Examiner*—Andrew M. Dolinar
*Attorney, Agent, or Firm*—Kenyon & Kenyon

[57] ABSTRACT

An engine control apparatus for controlling a control parameter of an internal combustion engine equipped with an automatic transmission using a torque converter with a lock-up clutch. The an engine control apparatus which includes a measurement part for measuring a number of cycle-by-cycle changes of torque generated in the internal combustion engine for plural operating cycles thereof, a calculation part for calculating a torque variation value on the basis of the measured cycle-by-cycle torque changes for the plural operating cycles measured by the measurement part, a parameter control part for adjusting a control parameter of the internal combustion engine so that the torque variation value calculated by the calculation part substantially agrees with a target torque variation value which is predetermined in response to an operating condition of the engine, and a detection part for generating a signal indicative of whether or not the lock-up clutch is in operation, wherein the parameter control part adjusts the control parameter of the engine based on the detection signal generated by the detection part in such a way that the target torque variation value is lowered when the lock-up clutch is in operation and the lowered target torque variation value is smaller than a target torque variation value when the lock-up clutch is not in operation.

10 Claims, 14 Drawing Sheets

MAP - B (LOCK-UP CLUTCH "OFF")

| QN | | | | |
|---|---|---|---|---|
| 0.85 | 0.85 | 0.90 | 0.90 | 0.95 |
| 0.85 | 0.85 | 0.90 | 0.90 | 0.95 |
| 0.80 | 0.80 | 0.85 | 0.85 | 0.90 |
| 0.80 | 0.80 | 0.85 | 0.85 | 0.90 |

1000 2000 3000

NE (rpm)

FIG. 14A

MAP - C (LOCK-UP CLUTCH "ON")

| QN | | | | |
|---|---|---|---|---|
| 0.65 | 0.65 | 0.70 | 0.70 | 0.75 |
| 0.65 | 0.65 | 0.70 | 0.70 | 0.75 |
| 0.60 | 0.60 | 0.65 | 0.65 | 0.70 |
| 0.60 | 0.60 | 0.65 | 0.65 | 0.70 |

1000 2000 3000

NE (rpm)

FIG. 14B

APPARATUS FOR CONTROLLING INTERNAL COMBUSTION ENGINE

BACKGROUND OF THE INVENTION (1) Field of the Invention

The present invention generally relates to an apparatus for controlling an internal combustion engine, and more particularly to an engine control apparatus for adjusting a control parameter of an internal combustion engine equipped with an automatic transmission using a torque converter with a lock-up clutch, the control parameter being so adjusted that a cycle-by-cycle variation of torque output by the engine substantially agrees with a target torque variation when the engine is in a prescribed operating condition.

(2) Description of the Related Art

Conventionally, there is a known engine control device in which a cycle-by-cycle variation of torque generated in each of a plurality of cylinders of an internal combustion engine is detected and it is corrected so as to substantially agree with a target torque variation by adjusting an air-fuel ratio of the engine to make the air-fuel mixture as lean as possible, or by increasing or decreasing the quantity of exhaust gas recirculation (EGR quantity) therein. The primary purpose of the conventional device is to improve the fuel consumption of an internal combustion engine and reduce the amount of nitride oxides (NOx) in the exhaust gas thereof.

Japanese Laid-Open Patent Application No. 2-67446, for example, discloses a conventional engine control device of this type. In this engine control device, only a torque decrease is detected in each operation cycle and a cycle-by-cycle torque variation is calculated by totaling such torque changes in a number of operation cycles. The calculated torque variation is compared with a target torque variation, and an engine control parameter such as the air-fuel ratio or the EGR quantity is corrected on the basis of the result of the comparison, so that an air-fuel mixture is substantially at its lean limit. This method of controlling the engine control parameter is called herein a lean limit control.

In a case in which such a conventional device is applied to an internal combustion engine which is equipped with an automatic transmission using a torque converter with a lock-up clutch, there is a problem in that the target torque variation is determined in response to the engine operating conditions such as engine speed and load thereon, irrespective of whether or not the lock-up clutch is in ON state.

An automatic transmission for automotive vehicles in general performs automatically the starting clutch operation and the shift operation for producing a desired traction force of the vehicle. From the aspect of functional operation, the system of the automatic transmission may be divided into three parts, which are a torque converter, a sub-transmission and a control part. The torque converter in the automatic transmission system serves to amplify power produced by an internal combustion engine and transmit the same from an input shaft of the torque converter to an output shaft thereof. A fluid-type torque converter makes use of fluid for the power transmission, but the torque converter of this type often causes a loss of the trasmitted power due to the slip in the fluid used therein. For preventing the loss of the transmitted power, a lock-up clutch is used in the above mentioned torque converter, and this lock-up clutch mechanically connects the input shaft of the torque converter to the output shaft thereof for the power transmission.

FIG. 1 shows the construction of a torque converter with a lock-up clutch. In FIG. 1, a torque converter 1 generally has a pump impeller 2, a turbine liner 3, a stator 4 and a lock-up clutch 7. The pump impeller 2 on the front side thereof is connected to a crankshaft (not shown) of an engine via a front cover 5 on the outer periphery of the torque converter 1. The turbine liner 3 is fitted to an OD input shaft 6 by a spline gear. The stator 4 which is located at an intermediate portion between the pump impeller 2 and the turbine liner 3 is so arranged that the stator 4 is rotatable only in one direction around the shaft 6. The lock-up clutch 7 which is fixed at its one end portion to the OD input shaft 6 by a turbine liner hub 8 is so arranged that the lock-up clutch 7 is connected in pressure contact with the front cover 5 and disconnected from the same in response to a difference in fluid pressure between the input side and the output side.

Next, a description will be given of the operation which is performed by the torque converter 1, with reference to FIG. 1. Power produced on a crankshaft by an internal combustion engine is transmitted to the pump impeller 2 in the torque converter 1. The pump impeller 2 is rotated around the shaft 6, and fluid between impeller blades flows from the central portion of the pump impeller 2 to the outer peripheral wall and the turbine liner 3, and it moves from the outer portion of the turbine liner 3 to the central portion thereof. Such movement of the fluid causes the driving and rotation of the turbine liner 3. The rotating force of the turbine liner 3 is transmitted to the OD input shaft 6, and the OD input shaft 6 is rotated integrally with the turbine liner 3. The flow of the fluid from the turbine liner 3 is changed in direction by the stator 4, and the fluid flowing from the stator 4 serves to increase the rotation of the pump impeller 2.

Next, the operation which is performed by the lock-up clutch 7 will be explained, with reference to FIGS. 2A and 2B. In FIGS. 2A and 2B, those parts which are essentially the same as those corresponding parts shown in FIG. 1 are designated by the same reference numerals, and a description thereof will be omitted. FIG. 2A shows schematically the torque converter 1 in which the lock-up clutch 7 is in ON state and connected in pressure contact with the front cover 5. In this case, the operation of a control valve 9 is so controlled by a control signal that the fluid flows in a direction indicated by an arrow X in FIG. 2A. The flow of the fluid allows the lock-up clutch 7 to be connected in pressure contact with the front cover 5 by a difference in fluid pressure between the input side and the output side, and it is rotated integrally with the front cover 5. Therefore, the power generated in the internal combustion engine is transmitted to the OD input shaft 6 from the lock-up clutch 7.

FIG. 2B shows the torque converter in which the lock-up clutch 7 is in OFF state and disconnected from the front cover 5. In this case, the operation of the control valve 9 is so controlled by a control signal that the fluid flows in a direction indicated by an arrow Y in FIG. 2B, which is opposite to the direction indicated by the arrow X in FIG. 2A. The flow of the fluid allows the lock-up clutch 7 to be disconnected from the front cover 5 by a difference in fluid pressure between the input side and the output side. Thus, the power generated in the internal combustion engine is transmitted to the OD input shaft 6 through the pump impeller 2 and the turbine liner 3.

Thus, when the lock-up clutch 7 is in operation (ON state), the torque generated in the internal combustion engine is transmitted directly to a driven shaft in the torque converter 1. But, when the lock-up clutch 7 is not in operation (OFF state), the torque produced by the engine is attenuated in the torque converter 1 and hardly transmitted to the driven shaft. As described above, in the case of the conventional engine control device, the target torque variation is predetermined, irrespective of whether or not the lock-up clutch 7 is in ON state. Accordingly, if the actual torque variation is substantially the same, the surge of an automotive vehicle when the lock-up clutch is in ON state is greater than that when the lock-up clutch is in OFF state, and therefore the driveability becomes worse in the case where the conventional engine control device is applied to an internal combustion engine which is equipped with an automatic transmission using a torque converter with a lock-up clutch.

SUMMARY OF THE INVENTION

Accordingly, it is a general object of the present invention to provide an improved engine control apparatus in which the above described problems are eliminated.

Another and more specific object of the present invention is to provide an engine control apparatus which varies a target target variation depending on whether or not the lock-up clutch is in ON state, thereby preventing the driveability from becoming poor when the lock-up clutch is in ON state. The above mentioned objects of the present invention can be achieved by an engine control apparatus which includes a measurement part for measuring a number of cycle-by-cycle changes of torque generated in the internal combustion engine for plural operating cycles thereof, a calculation part for calculating a torque variation value on the basis of the measured cycle-by-cycle torque changes for the plural operating cycles measured by the measurement part, a parameter control part for adjusting a control parameter of the internal combustion engine so that the torque variation value calculated by the calculation part substantially agrees with a target torque variation value which is determined in response to operating conditions of the engine, and a detection part for generating a detection signal indicative of whether or not the lock-up clutch is in operation, wherein the parameter control part adjusts the control parameter of the engine based on the detection signal generated by the detection part in such a way that torque variations occurring in the engine when the lock-up clutch is in operation are lowered from torque variations occurring in the engine when the lock-up clutch is not in operation. According to the present invention, it is possible to lower a target torque variation value when the lock-up clutch of the torque converter within the automatic transmission is in operation in such a way that the lowered target torque variation value is smaller than a target torque variation value when the lock-up clutch is not in operation. Therefore, it is possible for the present invention to control torque variations occuring in the internal combustion engine when the lock-up clutch is in operation so as to become smaller than those when the lock-up clutch is not in operation, thus allowing the surge level of the vehicle which a driver feels when the lock-up clutch is in operation to be reduced from the surge level in the conventional apparatus, and the driveability can be increased when compared with that in the conventional case.

Other objects and further features of the present invention will become more apparent from the following detailed description when read in conjunction with the accompanying drawings.

BRIEF DESCRIPTION OF THE DRAWINGS

FIGS. 14A and 14B are diagrams showing two-dimensional maps MAP-B and MAP-C from which a target torque variation value is obtained in the flow chart shown in FIG. 13.

DESCRIPTION OF THE PREFERRED EMBODIMENTS

Figure 3:
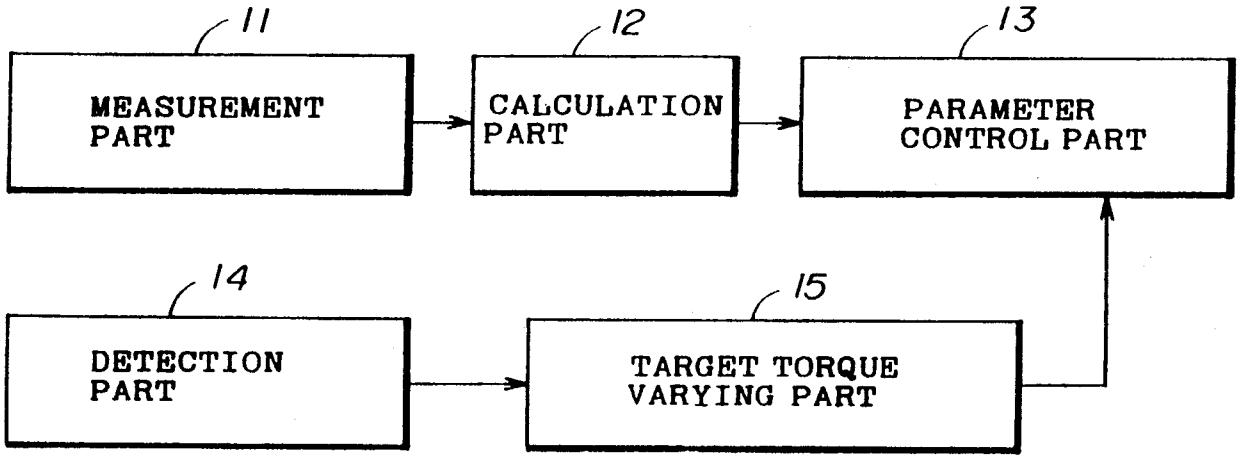
FIG. 3 is a block diagram showing a construction of an engine control apparatus according to the present invention.

A description will now be given of a construction of an engine control apparatus according to the present invention, with reference to FIG. 3. In FIG. 3, this engine control apparatus includes a measurement part 11 for measuring a number of cycle-by-cycle changes of torque generated in the internal combustion engine for plural operating cycles of the engine, a calculation part 12 for calculating a torque variation value on the basis of the measured cycle-by-cycle torque changes for the plural operating cycles measured by the measurement part 11, a parameter control part 13 for adjusting a control parameter defining a fuel injection time of the internal combustion engine so that the torque variation value calculated by the calculation part 12 substantially agrees with a target torque variation value determined in response to an operating condition of the engine, a detection part 14 and a target torque varying part 15. In this engine control apparatus, the detection part 14 determines whether the lock-up clutch of the torque converter in the automatic transmission is in ON state or in OFF state. In response to the determination by the detection part 14, the target torque varying part 15 varies the target torque variation value when the lock-up clutch is in ON state, so that the varied target torque variation value is smaller than a target torque variation value when the lock-up clutch is in OFF state. According to the present invention, the target torque variation value during the ON state of the lock-up clutch is varied to a value that is smaller than a target torque variation value during the OFF state of the lock-up clutch, a torque variation value in the engine when the lock-up clutch is in ON state can be adjusted to a value that is smaller than that when the lock-up clutch is in OFF state.

Figure 4:
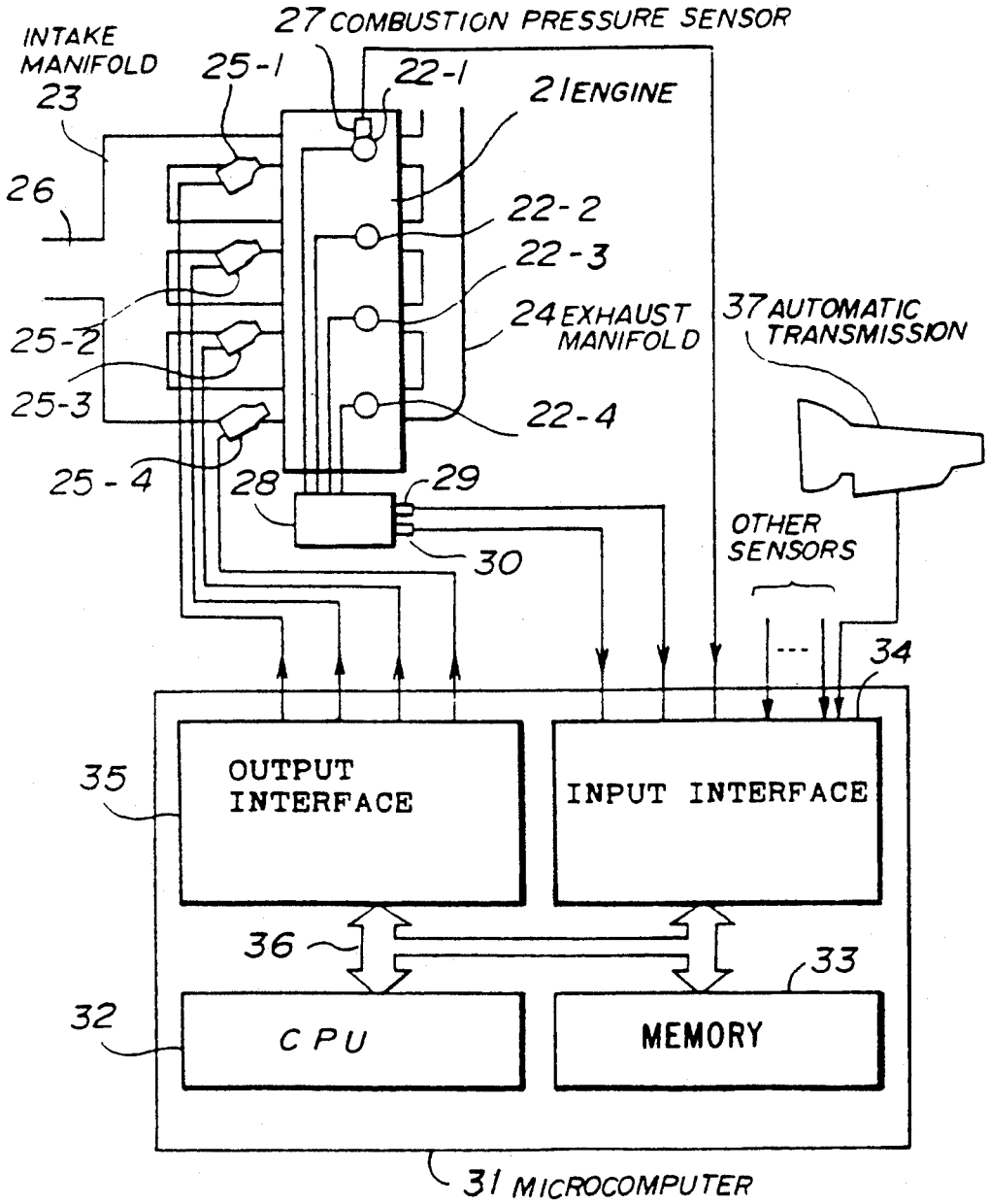
FIG. 4 is a schematic view showing a construction of an internal combustion engine with an automatic transmission to which the present invention is applied.

FIG. 4 shows a construction of a four-cylinder, spark-ignition type internal combustion engine to which the present invention is applied. The internal combustion engine 21 shown in FIG. 2 includes four cylinders #1 through #4 and four spark plugs 22-1 through 22-4 which are respectively mounted on the four cylinders. The engine 21 also includes an intake manifold 23 and an exhaust manifold 24, each combustion chamber of the cylinders being connected to the intake manifold 23 communicating with an intake passage 26 provided on the inlet side of the engine. Each combustion chamber of the four cylinders is also connected to the exhaust manifold 24 communicating with an exhaust pipe on the outlet side of the engine. Four fuel injection valves 25-1 through 25-4 are respectively mounted on four branch pipes leading to the intake manifold 23. A combustion pressure sensor 27 is mounted on, for example, the cylinder #1. This combustion pressure sensor 27 is preferably a heat-resistant, piezoelectric sensor which receives directly a combustion pressure produced in the combustion chamber of the cylinder #1 and generates a signal indicating the combustion pressure produced therein.

A distributor 28 supplies high voltage in proper sequence to the four spark plugs 22-1 through 22-4. A reference position sensor 29 and a crank angle sensor 30 are mounted on the distributor 28. The reference position sensor 29 supplies a signal indicating a reference position of a crankshaft each time the crankshaft's rotation angle has reached 720 deg CA (crank angle). The crank angle sensor 30 supplies a signal indicating a crank angle of the crankshaft to the microcomputer each time the rotation angle of the crankshaft increases by 30 deg CA.

As shown in FIG. 4, a microcomputer 31 includes a central processing unit (CPU) 32, a memory 33, an input interface 34 and an output interface 35. These components of the microcomputer 31 are interconnected by a bi-directional bus 36. The signals generated by the combustion pressure sensor 27, the reference position sensor 29, the crank angle sensor 30 and other sensors are each input to the input interface 34. The output interface 35 supplies control signals to the fuel injection valves 25-1 through 25-4, in proper sequence, for controlling ignition times at which fuel is injected by the fuel injection valves 25-1 through 25-4. The above mentioned parts 11 through 15 of the engine control apparatus according to the present invention are realized by the microcomputer 31 shown in FIG. 2.

Figure 1:
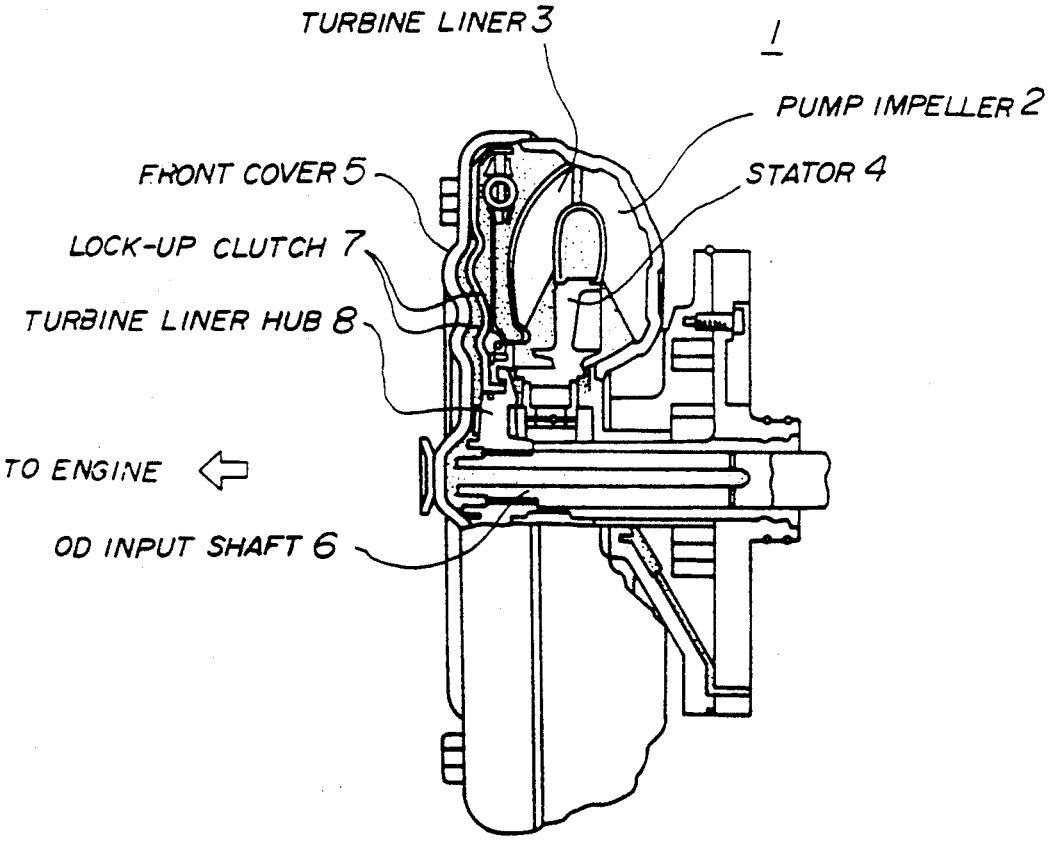
FIG. 1 PRIOR ART
FIG. 1 is a partially fragmentary view showing a torque converter having a lock-up clutch which is used in the prior art.
Figure 2A:
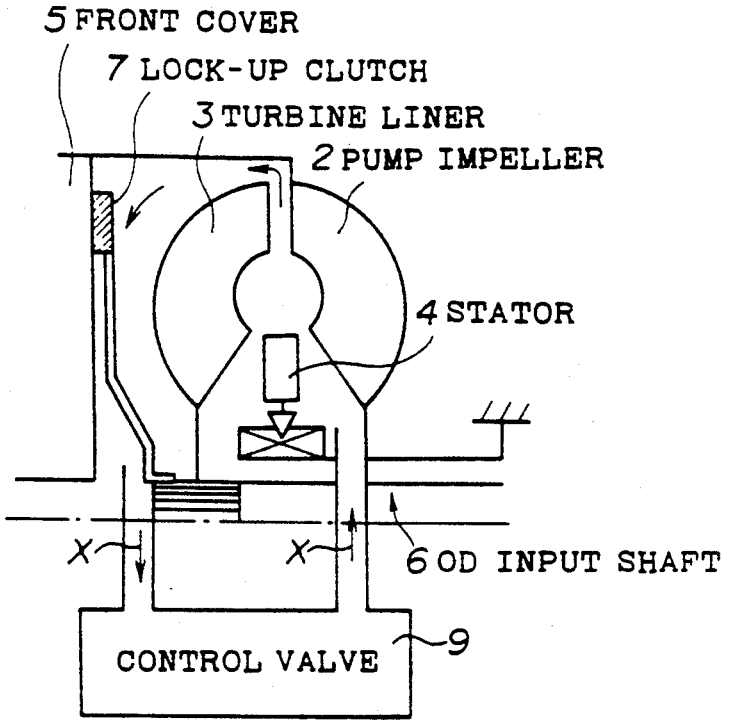
FIG. 2A PRIOR ART
FIGS. 2A and 2B are schematic views showing the torque converter in which the lock-up clutch is in ON state and the torque converter in which the lock-up clutch is in OFF state, respectively.
Figure 2B:
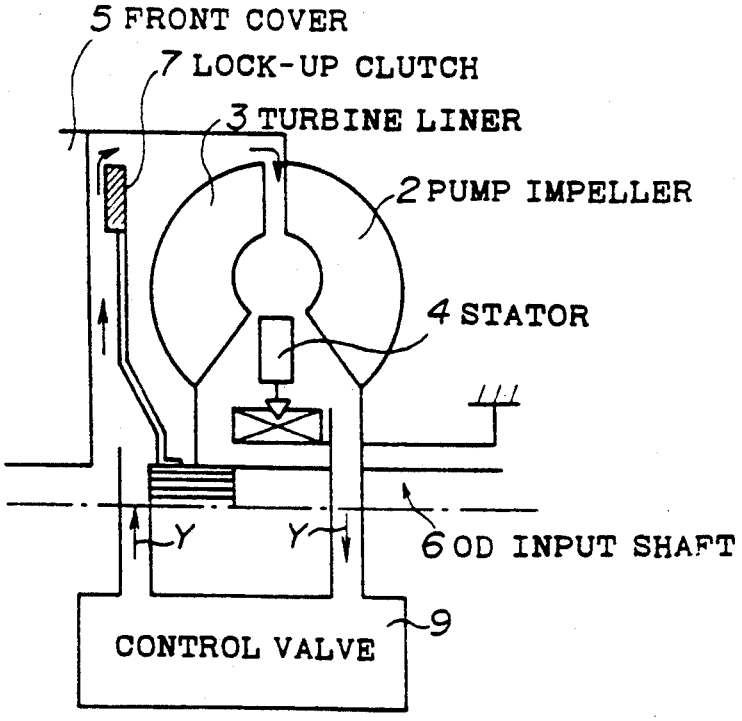
FIG. 2B PRIOR ART

The internal combustion engine shown in FIG. 4 is equipped with an automatic transmission 37 which uses the above described torque converter 1 with the lock-up clutch. A control signal which is supplied to the control valve 9 for controlling the flow of the fluid in the torque converter 1 is, for example, output to the input interface 34 of the microcomputer 31. This control signal is used as a detection signal for determining whether the lock-up clutch 7 is in ON state or in OFF state. More specifically, a control signal supplied to the control valve 9 for making the fluid in the torque converter 7 flow in the direction indicated by the arrow X in FIG. 2A is considered as a detection signal indicating that the lock-up clutch is in ON state, while a control signal supplied for making the fluid in the torque converter 7 flow in the direction indicated by the arrow Y in FIG. 2B is considered as a detection signal indicating that the lock-up clutch is in OFF state.

Figure 5:
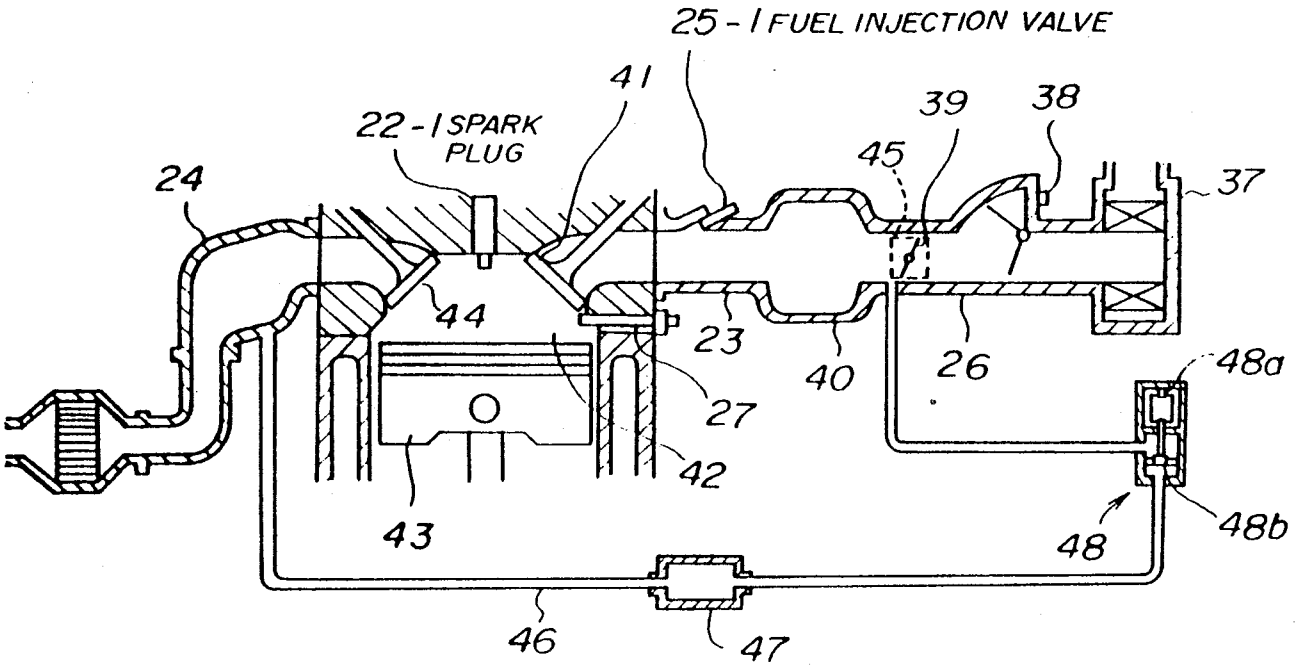
FIG. 5 is a sectional view showing a construction of one cylinder within the engine, shown in FIG. 4, and the neighboring portions of the cylinder.

FIG. 5 shows the construction of the cylinder #1 shown in FIG. 4 and the neighboring portions of the cylinder #1. In FIG. 5, those parts which are the same as those corresponding parts in FIG. 4 are designated by the same reference numerals, and a description thereof will be omitted. In FIG. 5, an air cleaner 37 for filtering external air entering the intake passage 26 is provided at an edge portion of the intake passage 26, and an air flow meter 38 for measuring a flow rate of air passing through the intake passage 26 is provided downstream of the air filter 37. A throttle valve 39 for controlling the flow of the air passing through the air cleaner 37 is provided at an intermediate portion of the intake passage 26 downstream of the air flow meter 38. Air passing through the throttle valve 39 is fed by a surge tank 40 appropriately into the intake manifold 23 leading to the four cylinders of the engine. In a case of the cylinder #1 shown in FIG. 5, the air sent from the surge tank 40 is mixed with the fuel injected by the fuel injection valve 25-1, and an air-fuel mixture is fed into a combustion chamber 42 of the cylinder #1 via an intake valve 41 when the intake valve 41 is open during operation of the engine.

A piston 43, corresponding to the cylinder #1, is arranged within the combustion chamber 42, and the combustion chamber 42 communicates with the exhaust passage 24 via an exhaust valve 44. The above described combustion pressure sensor 27 is secured in the engine block in such a way that a leading edge of the sensor 27 projects into the combustion chamber 42. A reference numeral 45 designates a throttle position sensor for detecting a valve open position of the throttle valve 39, and this throttle position sensor 45 supplies a signal indicating the valve open position of the valve 39 to the input interface 34 of the microcomputer 31. As shown in FIG. 5, a feedback passage 46 is provided between the exhaust manifold 24 and the intake passage 26 for feeding exhaust gas from the engine back to a portion of the intake passage 26 downstream of the throttle valve 39.

At intermediate portions of the feedback passage 46, an exhaust gas cooler 47 and an exhaust gas recirculation valve (EGRV) 48 are provided. The exhaust gas cooler 47 serves to cool exhaust gas flowing through the feedback passage 46 into a lower temperature. The EGRV 48 is provided to control the flow of exhaust gas recirculated from the exhaust manifold 24 to the intake passage 26, and the EGRV 48 includes a valve body 48*b* and a step motor with a rotor 48*a*. In response to a signal supplied from the microcomputer 31 to the EGRV 48, the rotor 48*a* of the step motor is rotated and a lift of the valve body 48*b* is adjusted by the rotation of the rotor 48*a* so that a valve open position of the EGRV 48 is controlled. Thus, by adjusting the valve open position of the EGRV 48 suitably, the flow of exhaust gas passing through the feedback passage 46 (from the exhaust gas cooler 47 to the intake passage 26) is controlled, thereby the quantity of exhaust gas recirculated to the intake passage 26 being controlled.

Figure 6A:
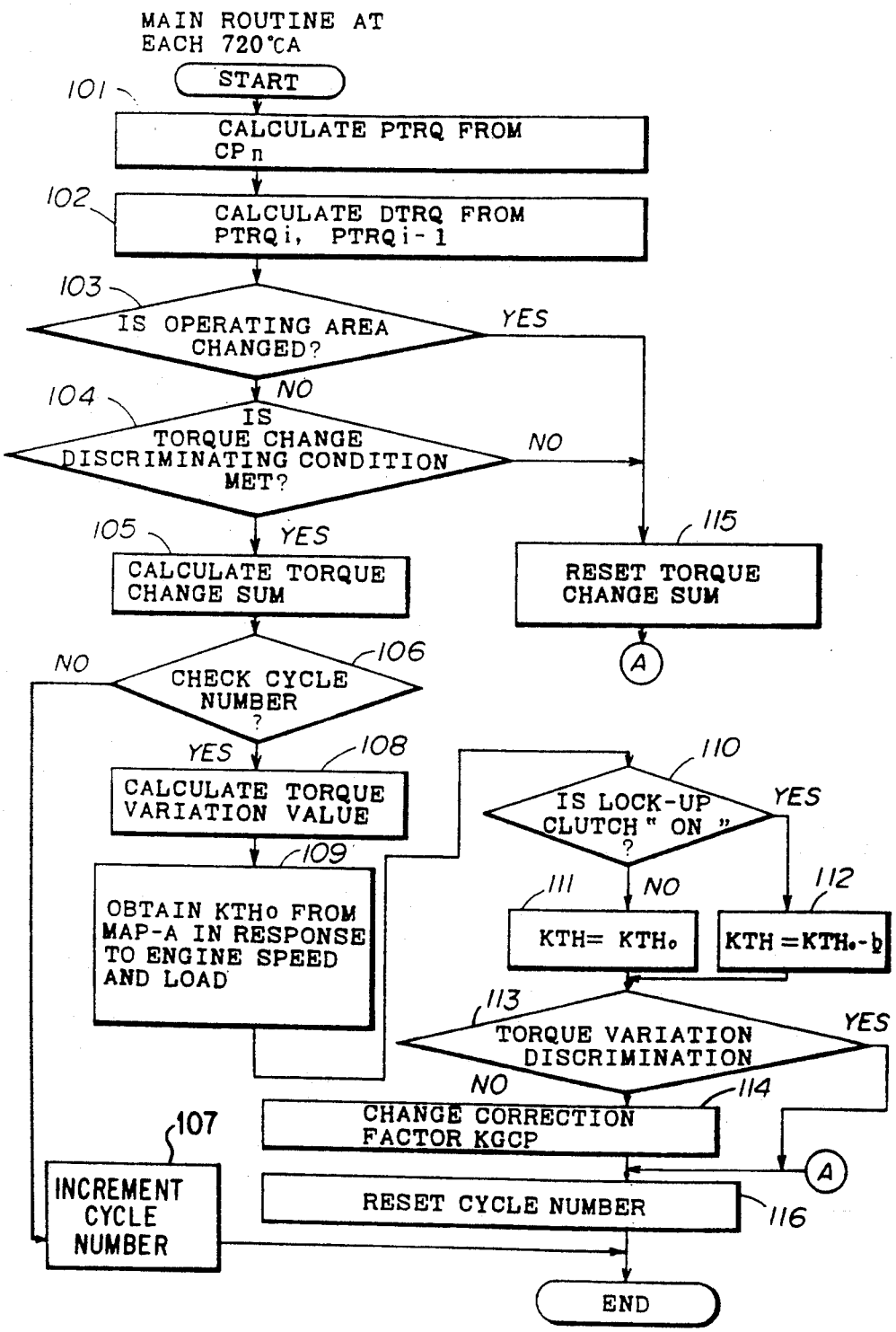
FIGS. 6A and 6B show flow charts for explaining a torque variation control routine which is performed in a first embodiment of the present invention.
Figure 6B:
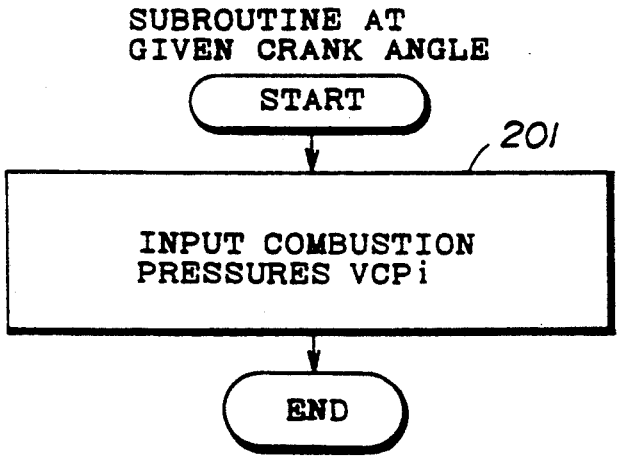

Next, a description will be given of a torque variation control process which is performed by the microcomputer 31. FIG. 6A shows a main routine for performing the torque variation control process as a first embodiment of the invention, and this main routine is started each time the crank angle of the crankshaft reaches 720 deg CA. FIG. 6B shows a subroutine for performing a cylinder pressure introducing process, and this subroutine is started by an interrupt each time the crank angle increases by a predetermined angle.

In the first embodiment, this predetermined angle of the crank angle is set to, for example, 30 deg CA. In the routine shown in FIG. 6B, a step 201 converts an analog signal indicating pressure in a combustion chamber of each of the engine cylinders, which analog signal is supplied by the combustion pressure sensor 27 to the input interface 34 of the microcomputer 31, into a digital signal through analog-to-digital conversion. This digital signal indicating the combustion pressure in each of the cylinders is stored in the memory 33 of the microcomputer 31 each time the crank angle is increased by a change of 30 deg CA. More specifically, digital signals indicating combustion pressures when the crank angle supplied by the crank angle sensor 30 has reached positions at BTDC (before top dead center) 155 deg CA, ATDC (after top dead center) 5 deg CA, ATDC 20 deg CA, ATDC 35 deg CA and ATDC 50 deg CA, are respectively stored in the memory 33 in the step 201.

Figure 7:
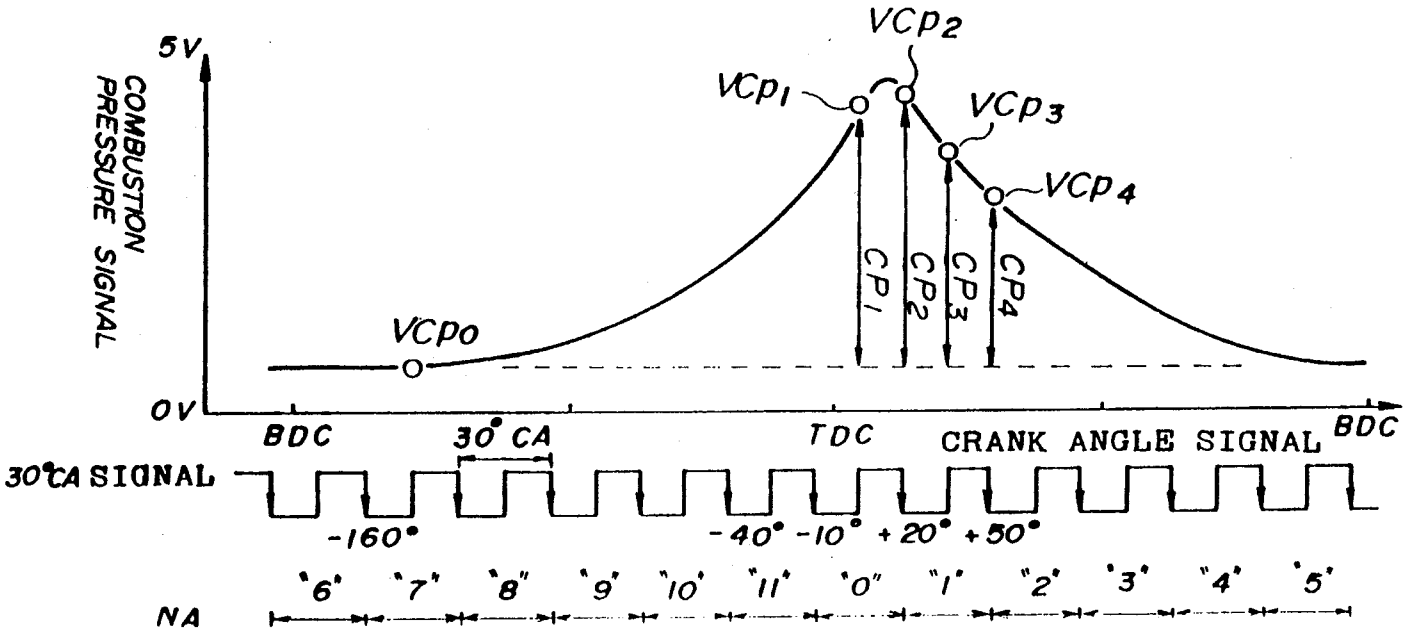
FIG. 7 is a chart showing a relationship between combustion pressure signals and crank angles.

FIG. 7 shows a relationship between the crank angle signals from the sensor 30 and the combustion pressure signals from the sensor 27. As described above, the subroutine shown in FIG. 6B is started by an interrupt which takes place repeatedly when the crank angle increases by changes of 30 deg CA. A 30 deg CA interrupt signal as shown in FIG. 7 is changed from OFF state to ON state each time the crank angle is changed by 30 deg CA. The ON state of the 30 deg CA interrupt signal corresponds to the first half of the 30 deg crank angle period, and the OFF state of the interrupt signal corresponds to the second half of the same, as shown in FIG. 7. A combustion pressure signal VCPo when the crank angle is equal to the BTDC 155 deg CA position indicates a reference combustion pressure with which other combustion pressures at other crank angle positions are compared. The reason why the combustion pressure signal VCPo at such a crank angle has been selected as the reference combustion pressure signal is for absorbing the drift of output signals from the combustion pressure sensor 27 due to temperature changes and reducing offset voltage variations by the combustion pressure sensor 27.

In FIG. 7, four combustion pressure signals VCP1, VCP2, VCP3 and VCP4 correspond to crank angle positions at ATDC 5 deg CA, ATDC 20 deg CA, ATDC 35 deg CA and ATDC 50 deg CA, respectively. And, "NA" in FIG. 7 designates a value of an angle counter which is incremented one by one when an interrupt takes place at intervals of 30 deg CA of the crank angle, and is reset to zero each time the crank angle has reached 360 deg CA. The combustion pressure signals VCP2 and VCP4 at the ATDC 20 deg and ATDC 50 deg CA positions which are stored in the memory 33 are in accordance with the ON state of the 30 deg CA interrupt signal, but the combustion pressure signals VCP1 and VCP3 at the ATDC 5 deg and 35 deg CA positions are not in accordance with the ON state of the 30 deg CA interrupt signal. The analog-to-digital conversion and memory storing of the combustion pressure signals VCP1 and VCP3 at these crank angle positions are performed by timer interrupts which are preset in the CPU 32 at the corresponding crank angle positions ("NA"="0", "1").

The main routine shown in FIG. 6A is started each time the crank angle, indicated by a signal from the sensor 30, has reached 720 deg CA, and the torque variation control routine is performed repeatedly at each 720 deg CA. In the main routine shown in FIG. 6A, a step 101 calculates the quantities of crankshaft torque in the cylinders on the basis of the combustion pressure signals VCPo, VCP1, VCP2, VCP3 and VCP4 which are each stored in the memory 33 in the step 201 above. In the step 301, combustion pressures CPn (n=1 to 4) are calculated by subtracting the reference combustion pressure indicated by the reference combustion pressure signal VCPo from each of combustion pressures indicated by the combustion pressure signals VCPn (n=1 to 4), as follows.

$$CPn = K1 \times (VCPn - VCPo) \text{ (n=1 to 4)} \quad (1)$$

In this formula, K1 is a correction coefficient which is predetermined based on the combustion pressure signal vs. combustion pressure characteristics. Then, the crankshaft torque PTRQ for each of the cylinders is calculated from the combustion pressures CPn (n=1 to 4) by the following formula.

$$PTRQ = K2 \times (0.5CP1 + 2CP2 + 3CP3 + 4CP4) \quad (2)$$

In this formula, K2 is a correction coefficient which is predetermined based on the combustion pressure vs. torque characteristics. A step 102 calculates a cycle-by-cycle torque change DTRQ with respect to each of the cylinders by the following formula.

$$DTRQ = PTRQ(i-1) - PTRQ(i) \text{ (DTRQ} \geqq 0) \quad (3)$$

Figures 8A, 8B, 8C, 8D, 8E:
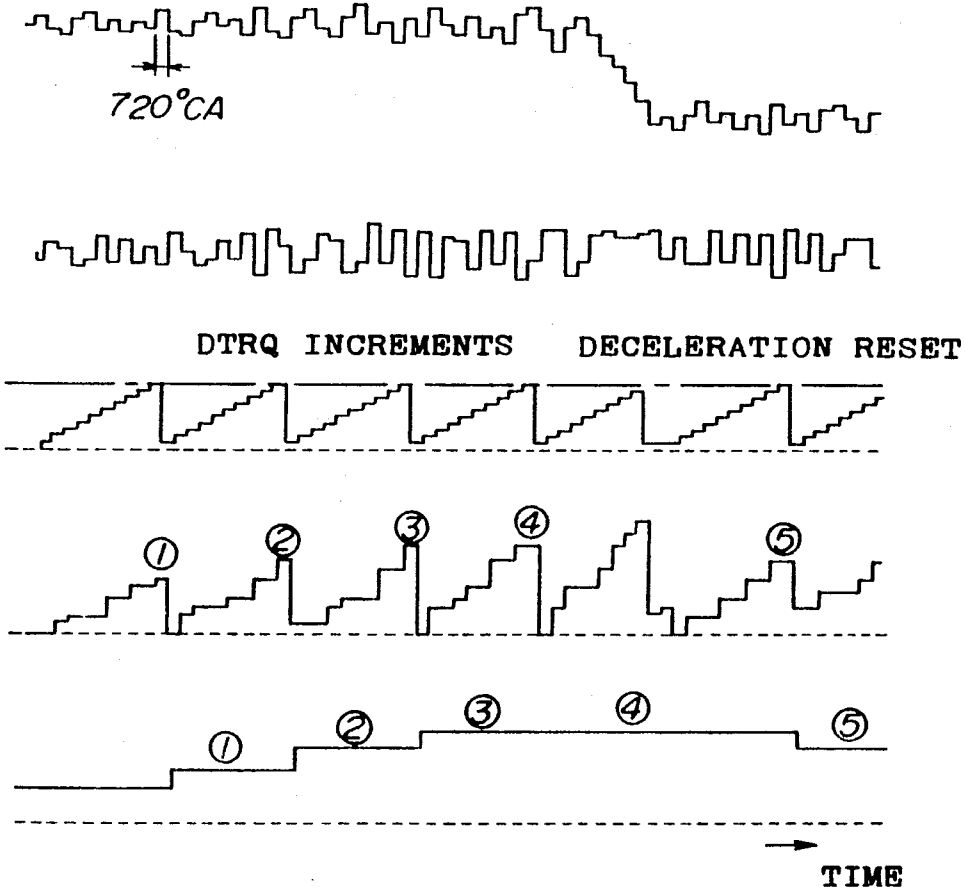
FIGS. 8A through 8E are time charts showing the changes in the crankshaft torque, the torque changes, the cycle number, the torque change sum and the integrated torque change sum.

In this formula, PTRQ(i) is the current crankshaft torque of the subject cylinder generated during the current cycle, and PTRQ(i−1) is the previous crankshaft torque of the same cylinder generated during the previous cycle. As indicated by the formula (3) above, the cycle-by-cycle torque change DTRQ is a difference between the current crankshaft torque and the previous crankshaft torque. In the present embodiment, it is assumed that a torque change is detected only when the value of the torque change DTRQ is greater than zero, in other words, when the current crankshaft torque decreases from the previous crankshaft torque. When the calculated crankshaft torque is not greater than zero, the torque change in such a case is negligible because it can be determined that the crankshaft torque is changed along the line of a theoretical torque change chart. In a case the crankshaft torque PTRQ with respect to one of the cylinders obtained from the formula (2) is varied in such a manner as shown in FIG. 8A, the value of the torque change DTRQ obtained from the formula (3) is varied as shown in FIG. 8B.

Next, a step 103 determines whether or not an operating area NOAREA(i), indicating the current driving conditions of the engine for the current cycle, is changed from an operating area NOAREA(i−1) indicating the previous driving conditions thereof for the previous cycle. If the operating area is not changed, a step 104 determines whether or not a torque change discriminating condition is met. A torque change discrimination value KTH (or, a target torque change quantity which will be described below), is preset for each operating area. There are several cases in which the torque change discrimination condition is not met, and these include, for example, cases in which the engine is in a deceleration condition, in an idling condition, in a starting condition, in a warm-up condition, in an EGR ON condition, in a fuel cut mode and so on. When any of the above mentioned cases is not met, it is assumed that the torque change discrimination condition in the step 104 is met, and a step 105 is next performed. In this connection, when the cycle-by-cycle torque change DTRQ obtained from the formula (3) for five consequetive cycles or more is greater than zero, it is assumed that the engine is in a deceleration condition. When the engine is a deceleration condition, it is difficult to distinguish a torque reduction due to a decrease in the intake air qunatity from a torque reduction due to a combustion deterioration, and therefore the engine control operation based on the torque change is stopped.

The step 105 calculates the sum DTH(i) of the cycle-by-cycle torque changes for the current cycle by adding the current torque change DTRQ, obtained in the step 102, to the previous torque change DTH(i−1) for the previous cycle by the following formula.

$$DTH(i)=DTH(i-1)+DTRQ \quad (4)$$

The above measurement part 11 of the present invention is realized by performing the step 105.

A step 106 checks whether or not the number of repeated cycles, which is herein referred to as a cycle number CYCLE10, has reached a predetermined number. This predetermined number of repeated cycles in the present embodiment is equal to, for example, 10. If the cycle number CYCLE10 does not yet reach 10, a step 107 increments the cycle number CYCLE10 by one, and this main routine shown in FIG. 6A ends and it is re-started when the crank angle has reached 720 deg CA for the following cycle.

FIG. 8C shows changes in the cycle number CYCLE10 described above. The predetermined number of repeated cycles with which the cycle number CYCLE10 is compared in the step 106 is indicated by a dotted chain line in FIG. 8C. After the cycle number CYCLE10 has reached the predetermined number, which is equal to, for example, 10, the cycle number CYCLE10 is reset to zero in the step 116. FIG. 8D shows changes in the cycle-by-cycle torque change DTRQ, and FIG. 8E shows changes in the torque change sum DTH(i) which is the result of adding the cycle-by-cycle torque change DTRQ repeatedly ten times in the step 105.

In the above described manner, the torque variation control process shown in FIG. 6A is repeated until the cycle number CYCLE10 has reached the predetermined number. When the cycle number CYCLE10 has reached the predetermined number, it is determined that the torque change sum calculated in the step 105 is approximately equal to a correct value of the actual torque variation. Then, a step 108 calculates a torque variation value TH(i) by the following formula:

$$TH(i)=(DTH(i)+DTH(i-1)++DTH(1-n))/(n+1) \quad (5)$$

In the formula (5) above, the torque variation value TH(i) is an average of the current torque change DTH(i) and a number ("n") of the previous torque changes DTH(i−1) through DTH(i−n), and this average is obtained by divding the sum of the torque changes by (n+1). In this connection, the torque variation value TH(i) may be calculated on the basis of another formula. For example, the torque variation value TH(i) may be obtained from the following formula.

$$TH(i)=(m\times TH(i-1)+DTH(i))/m \quad (5')$$

In this formula (5') above, the torque variation value TH(i) is calculated as a weighted average of the current torque change sum DTH(i) and a number ("m") of the previous torque variation values TH(i−1), and a weight factor in this case is equal to "m". The above calculation part 12 of the present invention is realized by performing the step 108.

Figure 10:
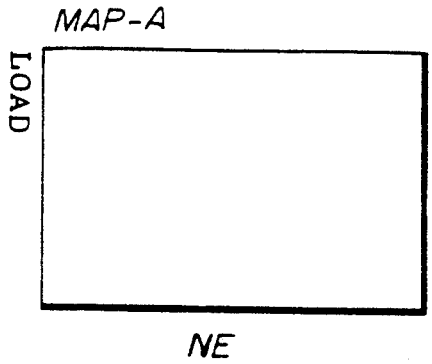
FIG. 10 is a diagram showing a two-dimensional map MAP-A from which a target torque variation is obtained in the flow chart shown in FIG. 6.

After the calculation of the torque variation value TH(i) has been done, a step 109 obtains a target torque variation value KTHo based on relevent data which is read out in response to the current driving conditions of the engine from a two-dimensional map MAP-A shown in FIG. 10, the contant of which is stored beforehand in the memory 33. This two-dimensional map MAP-A describes a relationship between engine speed NE and load (for example, intake air quantity QN). More specifically, the current speed of the engine is obtained based on a crank angle signal supplied from the crank angle sensor 30, and the current load is obtained based on the intake air quantity QN supplied from the air flow meter 38. The CPU 32 reads out four approximate values, stored beforehand in the memory 33, from the two-dimensional map MAP-A in response to each of the engine speed and the load, and it determines a target torque variation value KTHo through an interpolation method. The content of the two-dimensional map MAP-A is predetermined in conformity with the condition when the lock-up clutch 7 is in OFF state.

Following the step 109, a step 110 checks whether or not the lock-up clutch 7 is in ON state on the basis of the above described detection signal supplied to the control valve 9 of the torque converter. If the lock-up clutch 7 is in ON state, a step 111 determines a final target torque variation KTH as being equal to the target torque variation value KTHo (KTH=KTHo), obtained in the step 109 from the two-dimensional map MAP-A. If the lock-up clutch 7 is not in ON state, a step 112 determines the final target torque variation value KTH by subtracting a predetermined value b from the above target torque variation value KTHo obtained in the step 109 (KTH=KTHo−b). Accordingly, the target torque variation value KTH when the lock-up clutch is in ON state is smaller than the KTH when the lock-up clutch is in OFF state by a predetermined value b. The above target torque varying part 15 of the present invention is realized by performing the steps 110 to 112.

Next, a step 113 performs a torque variation discrimination by comparing the torque variation value TH(i) obtained in the step 108 with the target torque variation value KTH obtained in the step 111 or 112. This torque variation discrimination is performed by determining whether or not the torque variation value TH(i) obtained in the step 108, lies within an insensitive range a width of which is indicated by a (which is greater than b described above). In this regard, the target torque variation value KTH obtained in the step 111 or 112 is an upper limit of the insensitive range. In other words, when the torque variation value TH(i) does not lie within the insensitive range (KTH−a≧TH(i) or TH(i)≧KTH), a step 114 is performed in order to change a correction factor KGCPi for adjusting a fuel injection time with respect to each of the cylinders, and the step 116 is then performed to reset the cycle number CYCLE10 to zero. When the torque variation value TH(i) lies within the insensitive range (KTH−a<TH(i)<KTH), only the step 116 is performed without changing a correction factor KGCPi.

In the step 114, the correction factor KGCPi is changed as follows:

(i) when TH(i)≧KTH, $$KGCPi = KGCPi - 1 - 0.4\sigma \quad (6)$$

(ii) when TH(i)≦KTH−a, $$KGCPi = KGCPi - 1 - 0.2\sigma \quad (7)$$

In the above case (i), the torque variation value TH(i) is deviating from the insensitive range and the TH(i) is greater than the target torque variation value KTH. In this case, the air-fuel mixture is too lean and unstable combustion is occurring, and it is necessary to stabilize the combustion as quickly as possible. In the above case (ii), the torque variation TH(i) is deviating from the insensitive range and the torque variation value TH(i) is smaller than the value of (KTH−a). In this case, the air-fuel mixture is rich and the combustion is occurring stably, but it is necessary to change the air-fuel ratio to a smaller value in order to improve the fuel consumption. As is apparent from the formulas (6) and (7), the quantity of the change to correct the correction factor KGCPi in the case (i) is preset as being greater than the quantity of the change to correct the correction factor KGCPi in the case (ii), so that the torque variation value TH(i) is changed so as to fall within the insensitive range smoothly and quickly.

Figure 11:
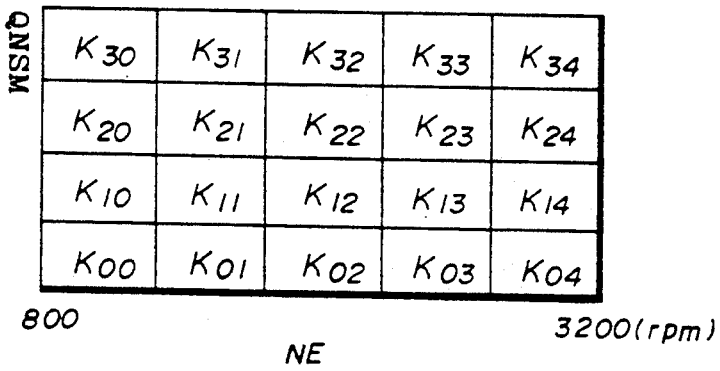
FIG. 11 is a diagram for explaining a two-dimensional map in which target torque variation values are stored.

FIG. 11 shows an example of the two-dimensional map in which target torque variation values in accordance with a relationship between the engine speed NE and the weighted average QNSM of intake air quantity, and this two-dimensional map is regularly divided into a set of learning areas K00 through K34. The correction factor KGCPi for adjusting the fuel injection time, calculated in the step 114, is stored in one learning area of the two-dimensional map, which learning area corresponds to the driving conditions of the engine, and the learning area in which the KGCPi is stored is selected from among the set of learning areas K00 through K34 in the two-dimentional map on the basis of the engine speed NE and the intake air quantity QNSM. The two-dimensional map with the learning areas K00 through K34 is stored in the memory 33.

After either the step 113 or the step 114 has been performed, the step 116 resets the cycle number CYCLE10 to zero and the main routine shown in FIG. 6A ends. When the step 103 determines that the operating area is changed, or when the step 104 determines that the torque change discrimination condition is not met, a step 115 resets the calculated torque change sums DTH(i−n) through DTH(i−1) to zero, and then the step 115 resets the cycle number CYCLE10 to zero and the main routine shown in FIG. 6A is completed.

Figure 6C:
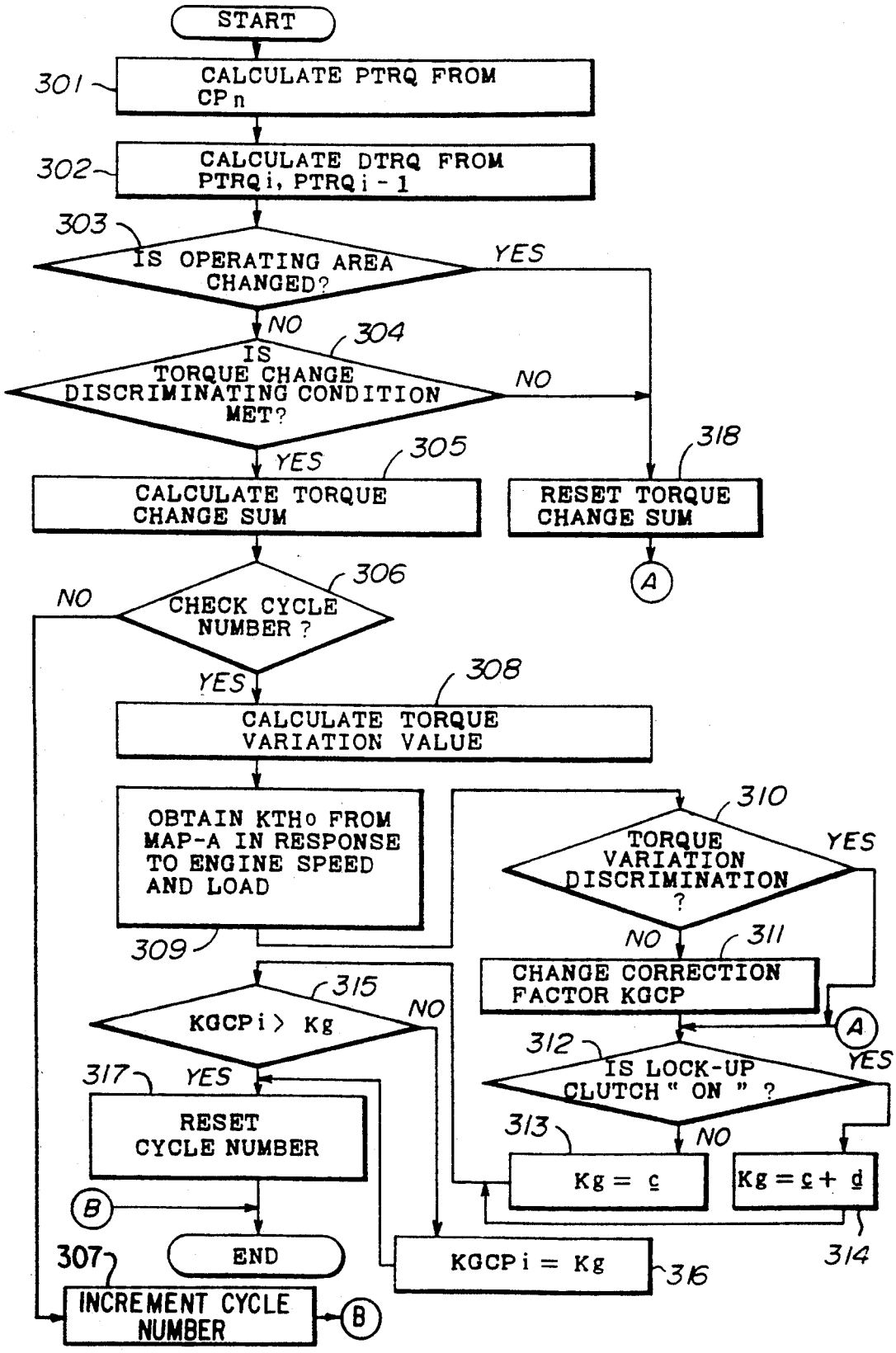
FIG. 6C is a flow chart for explaining a torque variation control routine which is performed in a second embodiment of the present invention.

Next, a description will given of a second embodiment of the present invention, with reference to FIG. 6C. FIG. 6C shows a torque variation control routine which is performed in the second embodiment. The steps 301 through 309 and the steps 317 and 318 in FIG. 6C are essentially the same as the steps 101 through 109 and the steps 116 and 115 in FIG. 6A, respectively, and a description thereof will be omitted.

After the calcualtion of the torque variation value TH(i) in the step 308 has been done, the step 309 determines a target torque variation KTHo from the two-dimensional map MAP-A which is stored beforehand in the memory 33 and the MAP-A describes a relationship between engine speed and intake air quantity. The steps 310 and 311 shown in FIG. 6C in this second embodiment correspond to the steps 113 and 114 shown in FIG. 6A. The step 310 performs a torque variation discrimination by determining whether or not the torque variation value TH(i) lies within the insensitive range a width of which is indicated by a. When the torque variation value TH(i) does not lie within the insensitive range (KTH−a ≧TH(i) or TH(i)≧KTH), the step 311 changes a correction factor KGCPi for adjusting a fuel injection time with respect to each of the cylinders. When the torque variation value TH(i) lies within the insensitive range (KTH−a<TH(i)<KTH), the step 312 is next performed without performing the step 311.

Next, a step 312 checks whether or not the lock-up clutch 7 is in ON state, based on the detection signal supplied to the control valve 9 of the torque converter, as in the step 110. When the lock-up clutch 7 is in OFF state, a step 313 determines a guard factor Kg by using a factor c read out from the two-dimensional map in response to the engine speed and the intake air quantity (Kg=c). When the lock-up clutch 7 is in ON state, a step 314 determines a guard factor Kg by adding a predetermined value d to the factor c from the two-dimensional map (Kg=c+d). Next, a step 315 checks whether or not the correction factor KGCPi, modified in the step 311, is greater than the guard factor Kg. If the correction factor KGCPi calculated in the step 311 is not greater than the guard factor Kg, a step 316 changes the correction factor KGCPi by setting the guard factor Kg to the correction factor KGCPi (KGCPi=Kg). If the correction factor KGCPi is greater than the guard factor Kg, the correction factor KGCPi remains unchanged. Also, in the second embodiment shown in FIG. 6C, the step 317 resets the cycle number CYCLE10 to zero.

Figure 9A:
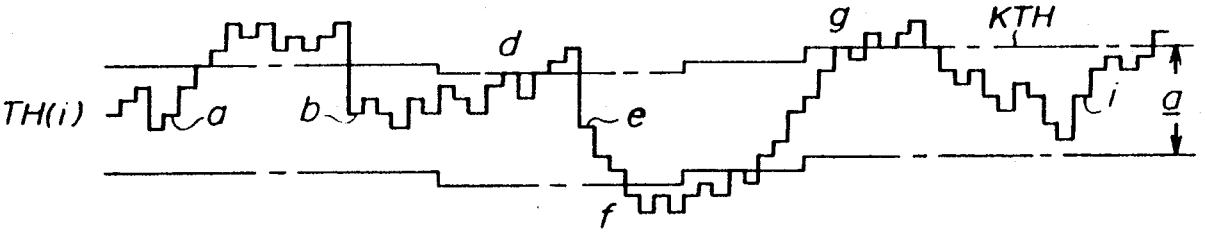
FIGS. 9A through 9C are time charts showing changes in the fuel injection correction factor and the torque variation.
Figure 9B:
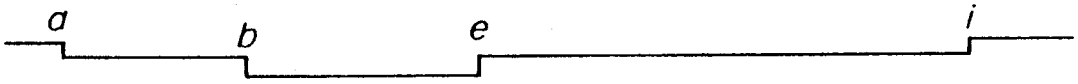

Next, a description will be given of the torque variation value TH(i), the correction factor KGCPi and the target torque variation value KTH, when the torque variation control process shown in FIGS. 6A to 6C is performed. FIG. 9A shows changes in the torque variation value TH(i). It is assumed that the operating area of the engine is changed at timings indicated by "a", "b", "e" and "i" in FIG. 9A. This operating area change is checked in the step 103 on the basis of engine speed and intake air quantity of the engine at that time. In accordance with the operating area changes, the reference number assigned to the learning area in which the fuel injection correction factor KGCP is stored is changed as shown in FIG. 9B. The target torque variation value KTH which is obtained from the two-dimensional map in the memory 33 through an interpolation method is changed as shown in FIG. 9A. In some cases, the target torque variation value KTH remains unchanged because the interpolation method is used.

Figure 9C:
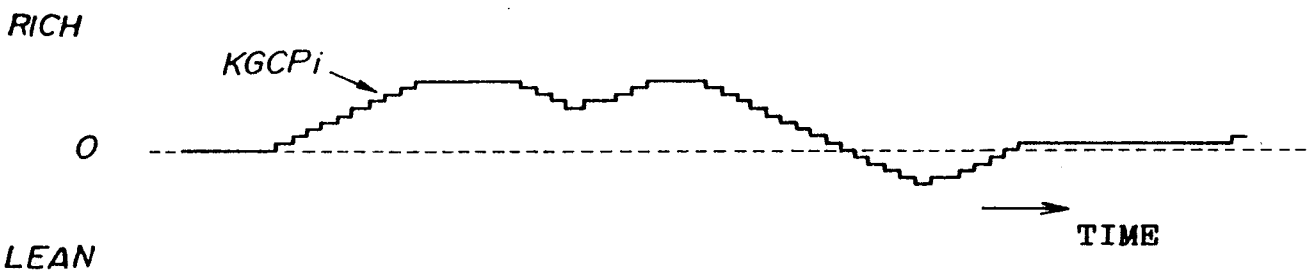

When the torque variation value TH(i) is changed to a value greater than the target torque variation value KTH (TH(i)≧KTH) immediately after the timing indicated by "a" or at the timings indicated by "d" and "g" in FIG. 9A, the correction factor KGCP(i), which is modified by the formula (6) so as to produce a rich mixture, is gradually increasing as shown in FIG. 9C. When the torque variation TH(i) is changed so as to fall within the range (TH(i)≦KTH−a) at the timing indicated by "f" in FIG. 9A, the correction factor KGCP(i), which is modified by the formula (7) so as to produce a lean mixture, is gradually decreasing as shown in FIG. 9C.

Figure 12:
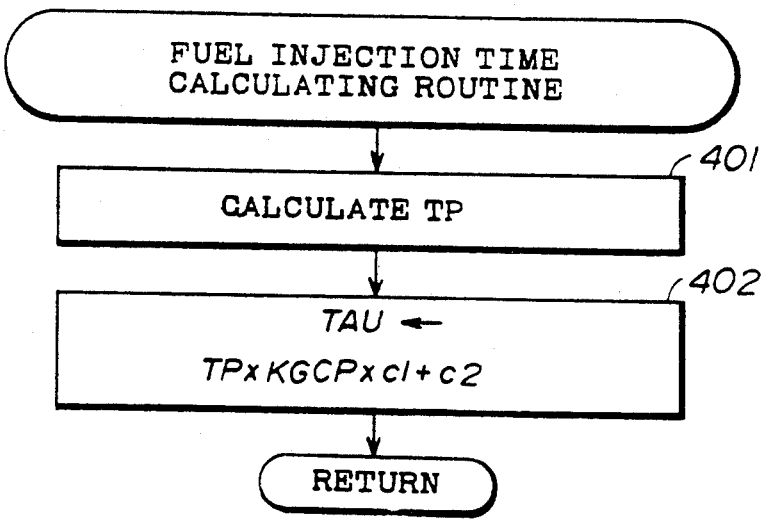
FIG. 12 is a flow chart for explaining a fuel injection time calculating routine which is performed according to the present invention.

Next, a description will be given of a fuel injection control process which is performed based on the correction factor KGCPi. FIG. 12 shows a fuel injection time calculating routine, and this routine is initiated each time the crank angle of the crankshaft has reached a predetermined angle which is preset to, for example, 360 deg CA. In the fuel injection time calculating routine, a step 401 calculates a basic fuel injection time TP with respect to each of the cylinders of the engine. In the step 501. relevant data corresponding to an intake air quantity QN and an engine speed NE is read out from the memory 33, and the basic fuel injection time TP is calculated from the relevant data. A step 402 calculates a fuel injection time TAU, from the basic fuel injection time TP and the correction factor KGCP described above, with respect to each of the engine cylinders, by the following formula:

$$TAU = TP \times KGCP \times c1 - c2 \quad (8)$$

In the formula (8) above, c1 and c2 are correction factors that are determined depending on other operating condition parameters, which parameters are, for example, a throttle valve position and an idling coefficient. Fuel injection with respect to the four cylinders is carried out, by means of the respective fuel injection valves 25-1 through 25-4 described above, on the basis of the fuel injection time which has been calculated in the step 402.

When the torque variation value TH(i) is greater than the target torque variation value KTH and the correction factor KGCPi is calculated by using the formula (6) in the step 114, the KGCP to be substituted into the formula (8) is changed as being greater than in the previous cycle. The fuel injection time TAU calculated based on the formula (8) is thus increased and the fuel injection is modified so as to provide a relatively rich air-fuel mixture in the combustion chamber. On the other hand, when the torque variation value TH(i) is smaller than the (KTH−a) and the correction factor KGCPi is calculated by using the formula (7) in the step 114, the KGCP to be substituted into the formula (8) is changed as being smaller than in the previous cycle. The fuel injection time TAU calculated based on the formula (8) in this case is thus decreased and the fuel injection is modified so as to provide a relatively lean air-fuel mixture in the combustion chamber. Accordingly, the above mentioned parameter control part 13 of the present invention is realized by performing the routine shown in FIG. 12 and the steps 113, 114 shown in FIG. 6A.

As described above, according to the present invention, the target torque variation value KTH when the lock-up clutch is in operation is changed as being smaller than the counterpart when the lock-up clutch is not in operation, and the torque variation value TH in the engine during the ON state of the lock-up clutch is lowered from the counterpart during the OFF state of the lock-up clutch. Therefore, even if the torque variation occurring in the engine when the lock-up clutch is in ON state, which torque variation is lowered according to the present invention, is transmitted directly to a driven shaft, it is possible to prevent the surge level of the vehicle during the ON state of the lock-up clutch from becoming greater than the surge level of the vehicle when the lock-up clutch is in OFF state, and the surge level of the vehicle when the lock-up clutch is in ON state can be maintained approximately at the same surge level of the vehicle when the lock-up clutch is in OFF state. Thus, according to the present invention, the driveability can be improved when compared with that in the conventional case.

Because the surge level of the vehicle during the ON state of the lock-up clutch can be maintained at the same surge level thereof during the OFF state of the lock-up clutch, the target torque variation value KTH can be preset to a relatively high level, and the combustion control in the internal combustion engine can be carried out so as to make the air-fuel mixture be as lean as possible, thus improving the fuel consumption with respect to the engine when compared with the conventional case.

Figure 13:
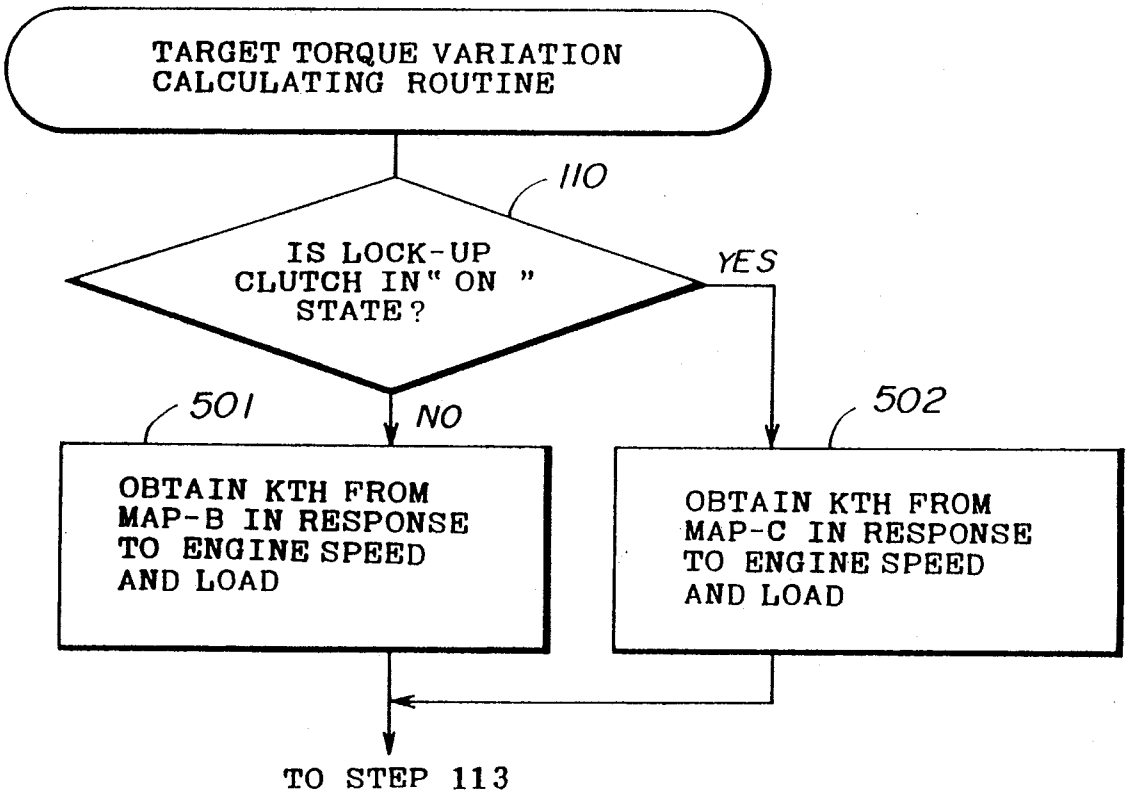
FIG. 13 is a flow chart for explaining a modified target torque variation calculating routine which is performed according to the present invention.

Next, a description will be given of a modification of the target torque variation calculating routine which constitutes the above mentioned target torque varying part 15 of the present invention. FIG. 13 shows a modified target torque variation calculating routine. This target torque variation calculating routine shown in FIG. 13 is performed in a manner similar to the routine shown in FIG. 6A, and the steps in the routine in FIG. 13 are performed instead of the steps 110 to 112 in FIG. 6A. The step 110, in the flow chart shown in FIG. 13, checks whether or not the lock-up clutch of the torque converter is in ON state. This step 110 shown in FIG. 13 is the same as that shown in FIG. 6A. When the step 110 determines that the lock-up clutch is not in ON state, a step 501 obtains a target torque variation value KTH from a two-dimensional map MAP-B, that is used only when the lock-up clutch is in OFF state, in response to the engine speed NE and the intake air quantity QN. FIG. 14A shows this two-dimensional map MAP-B which is stored in the memory 33. On the other hand, when the step 110 determines that the lock-up clutch is in ON state, a step 502 obtains a target torque variation value KTH from a two-dimensional map MAP-C, that is used only when the lock-up clutch is in ON state, in response to the engine speed NE and the intake air quantity QN. FIG. 14B shows this two-dimensional map MAP-C which is stored in the memory 33. As shown in FIGS. 14A and 14B, target torque variation values KTH stored in the MAP-C are preset to relatively small values when compared with those in the MAP-B with respect to the same engine speed and intake air quantity.

Further, the present invention is not limited to the above described embodiments, and variations and modifications may be made without departing from the scope of the present invention. For example, the procedure of changing the correction factor KGCPi in the step 114 shown in FIG. 6A may be modified. In a case of such a modified procedure, when the correction factor KGCPi is changed as being greater than in the previous cycle, the valve open position of the EGRV 48 shown in FIG. 5 is changed as being narrower than in the previous cycle, so that the EGR amount into the intake passage is reduced and the torque variation in the engine is modified as being smaller than in the previous cycle. On the other hand, when the correction factor KGCPi is changed as being smaller than in the previous cycle, the valve open position of the EGRV 48 is changed as being wider than in the previous cycle, so that the EGR amount into the intake passage is enlarged and the torque variation in the engine is modified as being greater than in the previous cycle. Also, the present invention is applicable to an engine control apparatus in which a lean limit control is carried out without using the insensitive range of the torque variation value TH(i).

What is claimed is:

1. An engine control apparatus for controlling a control parameter of an internal combustion engine equipped with an automatic transmission using a torque converter with a lock-up clutch, comprising:

measurement means for measuring a number of cycle-by-cycle changes of torque generated in the internal combustion engine for plural operating cycles thereof;

calculation means for calculating a torque variation value based on said measured cycle-by-cycle torque changes for the plural operating cycles measured by said measurement means;

parameter control means for adjusting a control parameter of the internal combustion engine so that the torque variation value calculated by said calculation means substantially agrees with a target torque variation value which is determined in response to operating conditions of the engine; and detection means for generating a detection signal indicative of whether or not the lock-up clutch is in operation;

wherein said parameter control means adjusts the control parameter of the engine based on the detection signal generated by the detection means in such a way that torque variations occurring in the engine when the lock-up clutch is in operation are lowered from torque variations occurring in the engine when the lock-up clutch is not in operation.

2. The apparatus as claimed in claim 1, wherein said parameter control means varies the target torque variation value when the lock-up clutch is in operation, so that said varied target torque variation value is smaller than a target torque variation value when the lock-up clutch is not in operation, thereby lowering torque variations occurring in the engine.

3. The apparatus as claimed in claim 1, wherein said parameter control means varies a range within which a control parameter of the engine can change when the lock-up clutch is in operation, thereby lowering torque variations occurring in the engine.

4. The apparatus as claimed in claim 1, wherein said target torque variation value is determined in each cycle, in response to a relationship between engine speed and intake air quantity of the internal combustion engine, said target torque variation value being read out from a two-dimensional map previously stored in a memory included in a microcomputer.

5. The apparatus as claimed in claim 1, wherein the control parameter of the internal combustion engine adjusted by said parameter control means is a fuel injection time defining a fuel injection quantity with respect to each of the cylinders of the engine.

6. The apparatus as claimed in claim 2, wherein said target torque varying means includes a memory means in which a first two-dimensional map describing target torque variation values used when the lock-up clutch is not in operation and a second two-dimensional map describing target torque variation values used when the lock-up clutch is in operation are stored, said target torque variation values in said second two-dimensional map are each preset to a value smaller than the corresponding target torque variation values in said first two-dimensional map with respect to the same engine speed and intake air quantity of the engine.

7. The apparatus as claimed in claim 1, wherein the control parameter of the internal combustion engine adjusted by said parameter control means is an exhaust gas recirculation quantity with respect to the internal combustion engine.

8. The apparatus as claimed in claim 1, wherein the adjustment of the control parameter is made by said parameter control means through changing of a correction factor for calculating a fuel injection time with respect to each of the cylinders.

9. The apparatus as claimed in claim 8, wherein the changing of the correction factor for calculating a fuel injection time with respect to each of the cylinders is performed in each operation cycle by said parameter control means after a detection signal indicative of whether or not the lock-up clutch is in operation has been generated by said detection means.

10. The apparatus as claimed in claim 8, wherein the changing of the correction factor for calculating a fuel injection time with respect to each of the cylinders is performed in each operation cycle by said parameter control means before a detection signal indicative of whether or not the lock-up clutch is in operation has been generated by said detection means.

* * * * *

UNITED STATES PATENT AND TRADEMARK OFFICE

CERTIFICATE OF CORRECTION

PATENT NO. : 5,176,118

DATED : January 5, 1993

INVENTOR(S) : Kazuhiko NOROTA

It is certified that error appears in the above-indentified patent and that said Letters Patent is hereby corrected as shown below:

Title page, ABSTRACT, line 4, delete "an" before "engine".

ABSTRACT, line 5, delete "which" at beginning of line.

Column 3, line 31, delete "target"--. (second occurrence).

Column 9, line 2, between "case" and "the" insert --where--.

Column 9, line 28, change "consequetive" to --consecutive--.

Column 9, line 30, between "is" and "a" insert --in--.

Column 9, line 32, change "qunatity" to --quantity--.

Column 10, line 38, change "contant" to --content--.

Column 11, line 10, after "range" insert a comma.

Column 12, line 21, change "calcualtion" to --calculation--.

UNITED STATES PATENT AND TRADEMARK OFFICE

CERTIFICATE OF CORRECTION

PATENT NO. : 5,176,118

DATED : January 5, 1993

INVENTOR(S) : Kazuhiko NOROTA

It is certified that error appears in the above-indentified patent and that said Letters Patent is hereby corrected as shown below:

Column 12, line 32, after "range" insert a comma.

Column 12, line 46, change "read out" to --readout--.

Signed and Sealed this

Eleventh Day of February, 1997

*Attest:*

*Attesting Officer*

BRUCE LEHMAN

*Commissioner of Patents and Trademarks*